United States Patent [19]

Swietlik

[11] Patent Number: 4,754,821

[45] **Date of Patent: * Jul. 5, 1988**

[54] LOCKING DEVICE

[76] Inventor: George Swietlik, Broad View Rd, Oulton Broad, Lowestoft, Suffolk, Great Britain, NR32 3PL

[ * ] Notice: The portion of the term of this patent subsequent to Feb. 25, 2003 has been disclaimed.

[21] Appl. No.: 925,644

[22] Filed: Oct. 31, 1986

[30] Foreign Application Priority Data

Oct. 31, 1985 [GB] United Kingdom ..... 8526876

[51] Int. Cl.[4] ..... E21B 7/10

[52] U.S. Cl. ..... 175/325; 166/187

[58] Field of Search ..... 175/325; 166/187, 213, 166/323, 333, 334, 241

[56] References Cited

U.S. PATENT DOCUMENTS

| | | | |
|---|---|---|---|
| 4,572,305 | 2/1986 | Swietlik | 175/325 |
| 4,577,695 | 3/1986 | Wood | 166/187 |
| 4,615,401 | 10/1986 | Garrett | 175/325 |
| 4,635,736 | 1/1987 | Shirley | 175/325 |

*Primary Examiner*—Stephen J. Novosad
*Assistant Examiner*—William P. Neuder
*Attorney, Agent, or Firm*—Reed Smith Shaw & McClay

[57] ABSTRACT

A locking device for use in an adjustable drill string stabilizer comprising a fluid reservoir provided in a first body member, the reservoir being divided into two chambers by a sealing piston secured on a second body member moveable relative to the first body member. The chambers of the reservoir are in fluid communication through a valve which is actuable to close said fluid communication between the chambers and thus prevent relative movement of the body members.

13 Claims, 9 Drawing Sheets

-15-
D

LOCKING DEVICE

FIELD OF THE INVENTION

This invention relates to a locking device for use in an adjustable stabilizer.

DESCRIPTION OF THE PRIOR ART

In the technique of directional drilling, a number of subsurface targets are drilled at angles to the vertical so as to obtain access to a wide spread of wells from a single platform.

To keep the borehole directed towards the target area stabilizers are provided on the drill string. Formerly the stabilizers were changed when it was necessary to effect drilling direction changes. As the changing of a stabilizer requires the drill string to be removed from the bore this operation was extremely time-consuming and expensive.

More recently stabilizers have been developed which can be adjusted from the surface. These stabilizers are usually maintained in a certain adjustment by the application of a predetermined force or fluid pressure which acts against a spring in the stabilizer. However, problems may arise with this type of stabilizer due to the difficulties in maintaining a near constant force or pressure on the drill string.

SUMMARY OF THE INVENTION

According to the present invention there is provided a locking device for use in an adjustable stabilizer comprising a fluid reservoir provided in a first body member, the reservoir being divided into two chambers by a moveable sealing member secured on a second body member moveable relative to the first body member, the chambers of the reservoir being in fluid communication through a valve which is actuable to close said fluid communication between the chambers.

Preferably, walls of the first and second body members define the fluid reservoir.

Preferably also, the fluid reservoir is in the form of an annular chamber, a wall of the second body member forming the inner wall of the chamber.

Preferably also, the sealing member is in the form of a piston mounted on the second body member and extending into the fluid reservoir.

Preferably also, the second body member is slidably moveable within the first body member.

Preferably also, the valve is mounted in the first body member. The valve may be mechanically actuated by a setting tool which comprises an elongate member having a cam surface provided thereon for engaging the valve. The setting tool may be supported by an upper portion of the second body member and movement of the second body member relative to the first body member may cause the cam surface to contact and close the valve thus locking the body members in position. The cam surface may be formed on a collar which is adjustable in position along the elongate member. By adjusting the collar on the elongate member it is possible to vary the relative movement between the first and second body members which is necessary before the cam surface contacts and closes the valve.

Alternatively, the valve may be electrically actuated by means of a sensor which detects changes in drilling mud flow through the sensor, the sensor having means for activating an electrical motor to close or open the valve on detection of such changes. Time delay means may be incorporated between the sensor and the motor such that the motor is activated when a predetermined time interval has elapsed following the sensor detecting a change in mud flow.

Further according to the present invention there is provided an adjustable stabilizer comprising a first outer body member having radially moveable projection members mounted thereon, and a second inner body member slidably moveable within the outer body member, portions of the projection members bearing on cam portions provided on the inner body member such that axial movement of the inner body relative to the outer body results in radial movement of the projection members, the stabilizer being provided with a locking device comprising a fluid reservoir in the outer body member, the reservoir being divided into two chambers by a moveable sealing member secured on the inner body member, the chambers of the reservoir being in fluid communication through a valve which is actuable to close said fluid communication between the chambers.

Still further according to the present invention there is provided an adjustable stabilizer comprising a first outer body member having radially moveable projection members mounted thereon, and a second inner body member slidably moveable within the outer body member, portions of the projection members bearing on cam portions provided on the inner body member such that axial movement of the inner body relative to the outer body results in radial movement of the projection members, part of the profile of at least one of the cam portions differing from the corresponding profiles of the other cam portions such that in a selected relative position of the inner body and outer body the projection member of said one cam portion is radially displaced from the outer body to an extent different from the projection members of the other cam portions.

Preferably, the cam portions have a non-linear profile.

Preferably also, each projection member is provided with two cam follower portions, one on each end portion the projection member.

BRIEF DESCRIPTION OF THE DRAWINGS

Embodiments of this invention will now be described by way of example with reference to the accompanying drawings, in which:

FIG. 2(*b*) is an exploded perspective view of part of the assembly of FIG. 2(*a*);

DETAILED DESCRIPTION OF THE PREFERRED EMBODIMENTS

Figure 1:
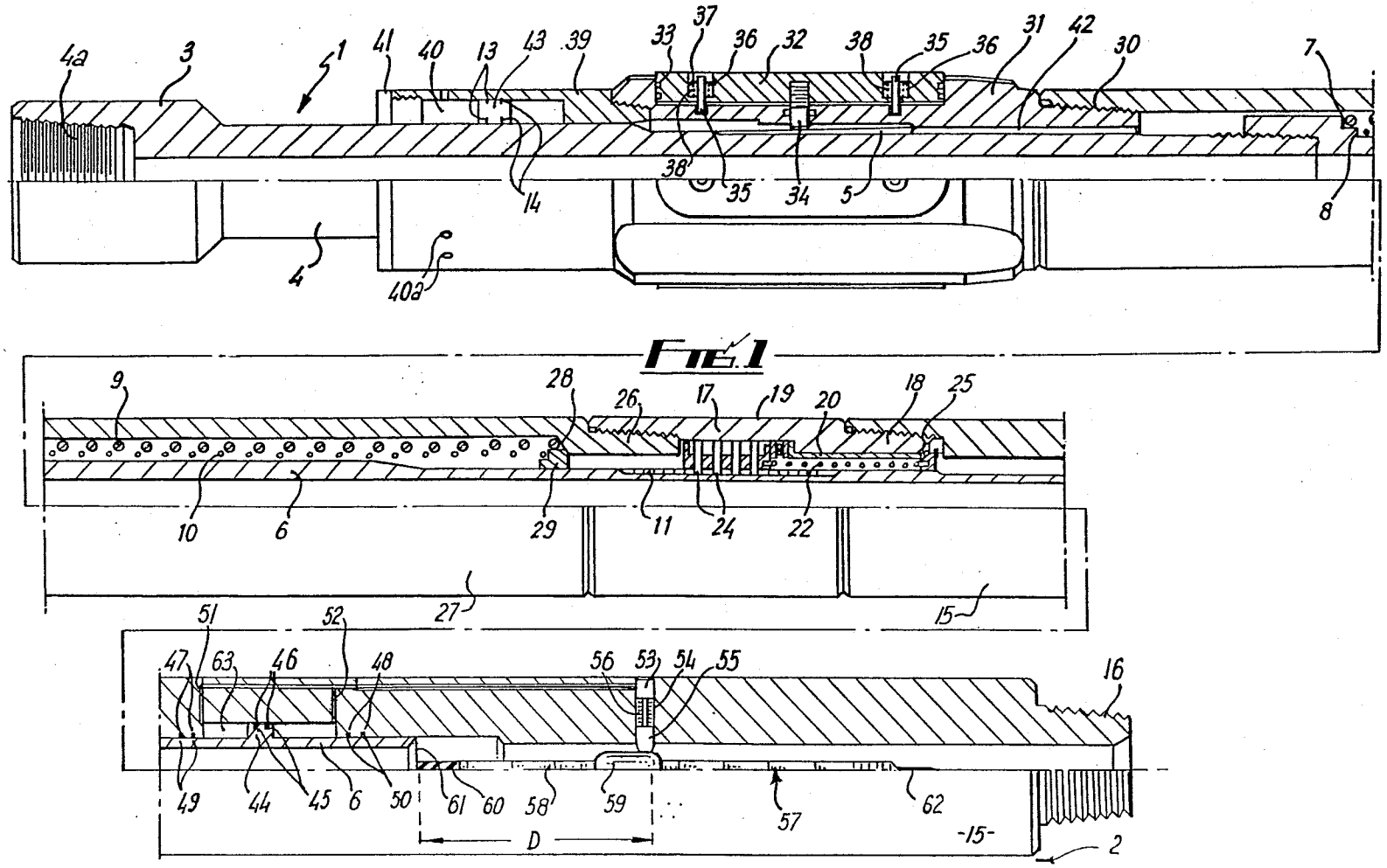
FIG. 1 is a side view, partly in section, of a stabilizer provided with a locking device of the present invention.
Figure 2A:
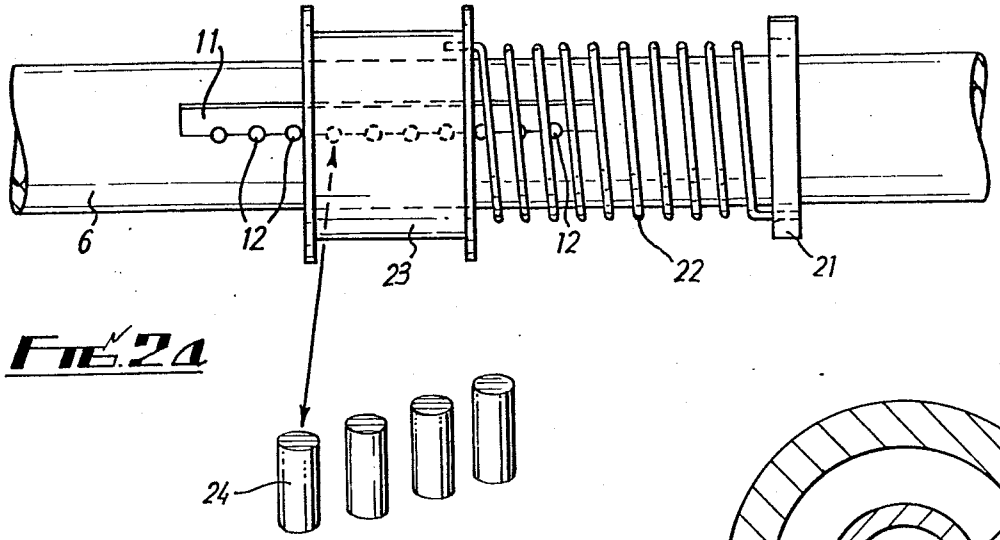
FIG. 2(*a*) is a side view of a preloading and stepwise transfer assembly of the stabilizer of FIG. 1.
Figure 3:
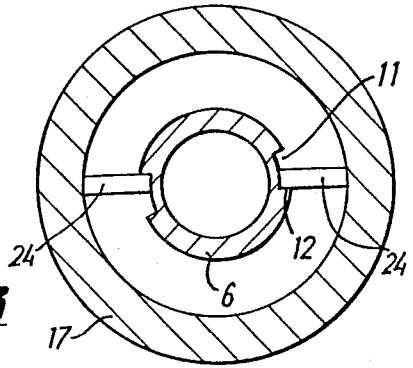
FIG. 3 is an end sectional view of the assembly of FIG. 2(*a*)
Figure 2B:
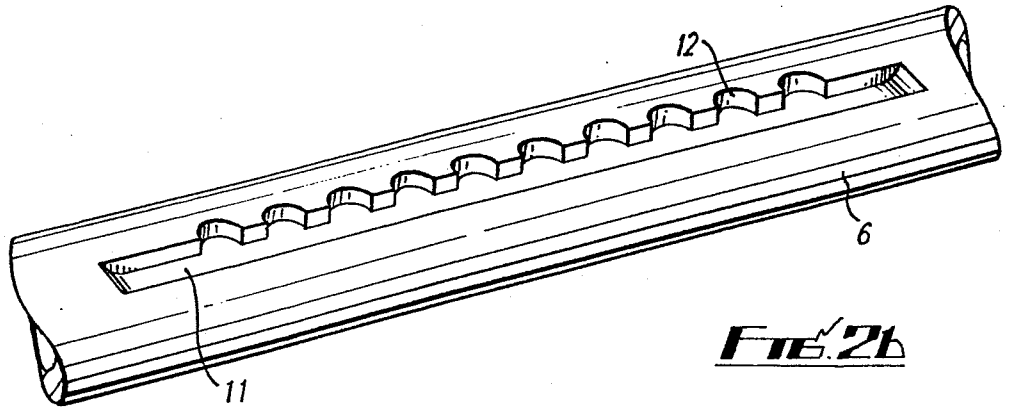
Figure 4:
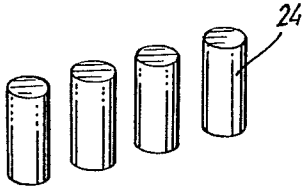
FIG. 4 is an end view of the stabilizer of FIG. 1.
Figure 4:
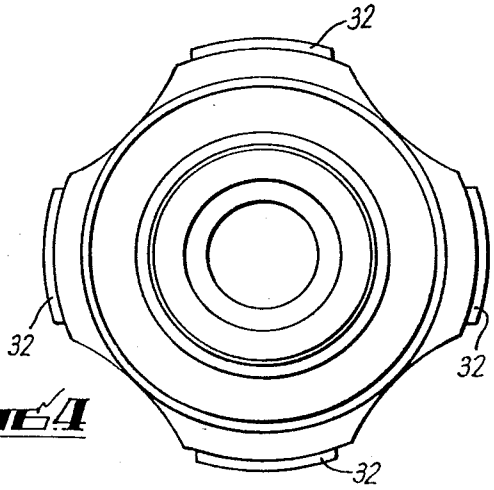

Referring to the drawings, FIGS. 1 to 4, a stabilizer provided with a locking device of this embodiment of the invention has a body which is in two main parts, namely first and second hollow cylindrical shaft assemblies 1 and 2. The assembly 1 comprises a shaft 4 having a pack-off end portion 3 which has a screw-threaded bore 4*a* for engagement with a complementary threaded end portion of part of a drill string (not shown) in which the stabilizer is disposed. The shaft 4 carries four fixed parallel projections 5 disposed at right-angles to one another around the shaft 4, these projections 5 all increasing in height along the shaft 4 so that their outer faces provide identically-inclined cam surfaces.

Screw-threaded onto the shaft 4 co-axially with it is a shaft 6 having a pair of stepped abutment faces 7,8 against which bear one end of respective compression springs 9,10, the spring 9 being of greater strength than the spring 10. (In other embodiments of the invention the compression springs 9,10 can be replaced by disc springs). The shaft 6 has longitudinal recesses 11 diametrically opposed in its outer face, one of the recesses 11 being shown in more detail in FIG. 2(*b*). Each of the recesses 11 has a side wall which has ten semi-circular cut-outs 12 equally spaced along it.

The free end of the shaft 15 is externally screw-threaded at 16 to provide means for connection to a complementary threaded bore of a part of a drill-string in which the stabilizer is to be disposed in use. The locking device of this embodiment of the invention is located within the shaft 15. An annular chamber 63 is provided in the wall of the shaft 15 and is filled with incompressible fluid. Disposed within the chamber 63 is piston 44 which projects from the shaft 6. The piston 44 is provided with a set of circumferential grooves 45 in which O-ring seals 46 are located. Sets of grooves 47 and 48 provided with O-ring seals 49 and 50 are also located on the shaft 15 above and below the chamber 63.

Hydraulic lines 51 and 52 lead, one from either end of the chamber 63 through the shaft 15 to an interconnecting valve 53 which, when open, permits fluid to flow from one hydraulic line to the other.

The valve 53 is located in the end portion of a radial bore 54 the inner portion of which houses a hydraulic valve actuator 55. The actuator 55 is inwardly biased by a spring 56 provided in the bore 54. A setting tool 57 is located within the shaft 15 between the end portion of the shaft 6 and the free end of the shaft 15. The setting tool 57 is in the form of a graduated shaft 58 having a collar 59 slidably mounted thereon. A solid rubber shock absorber 60 is provided on the end of the tool 57 and this rests upon a landing plate 61 provided at the end of the shaft 6. The other end of the tool 57 is provided with a spear head 62 for connection with a survey instrument.

The shaft 15 is screwed to one end of a short housing 17 forming part of the assembly 2, the housing 17 being generally cylindrical and having a stepped inner face providing a portion of smaller internal diameter 18 and a portion of larger internal diameter 19. A cylindrical liner 20 extends along the smaller diameter portion 18, terminating at one end by abutment against a preload setting ring 21 (see FIG. 2(*a*)) keyed or otherwise fixed against rotation on the external surface of the housing 17 and having an aperture which receives and anchors one end of a torsion spring 22 extending around the housing 17. The opposite end of the spring 22 is anchored on a cylindrical roller support 23 which carries four rollers 24. The support 23 is biassed by the spring 22 in such manner that the rollers 24 are held in engagement with four of the cutouts 12 of the shaft 6, thereby preventing relative axial movement of the shaft assemblies 1 and 2 until the force of the spring 22 is overcome.

The preload setting ring 21 can be adjusted by means of selectors 25 to alter the force exerted by the spring 22 on the roller support 23.

The housing 17 is secured through a screw connection 26 to a shaft 27 having on its inner face a shoulder 28 against which the spring 9 bears. The spring 10 bears against an abutment 29. At its other end the shaft 27 is screwed at 30 to a further cylindrical housing 31 which is recessed at four locations around its outer wall to receive slidable fins 32 sealed against the wall of the housing 31 by O-rings 33. Passing through the housing wall and screwed into each fin 32 is a cam follower 34 whose free-end bears against the cam surface of the corresponding projections 5.

A pair of posts 35 are secured within the wall of the housings 31 and extend into corresponding recesses 36 in the fins 32. The posts 35 carry collars 37 against which bear compression springs 38 biassing the fins 32 inwardly of the housing 31 against the projections 5.

The housing 31 and the shaft 4 are held against relative rotational movement by splines 42 around their mating faces, while relative axial movement remains possible.

A sleeve 39 is screwed to the housing 31 and a seal is formed between it and the shaft 4 by an end cap 41. An annular groove 40 is provided between the sleeve 39 and the shaft 4 and within this is located a fully floating annular piston 43 to allow for equilibrium of pressure between the internal workings and the external environment. The piston 43 has a set of circumferential grooves 13 in which O-ring seals 14 are located, the O-ring 14 providing seals between the piston 43 and respectively, the sleeve 39 and the shaft 4.

A series of ports 40*a* are provided in the sleeve 39 to allow mud to be displaced into and out of the groove 40 as the piston 43 moves to equalise pressure across the tool.

In use, the stabilizer is screwed into a drill string by means of the bore 4*a* and screw-thread 16 at a distance from the drill bit, and rotational drive is transferred to the drill bit through the stabilizer from the shaft assembly 1 to the shaft assembly 2 through the splines 42. During drilling an axial force may be also applied to the drill bit through the stabilizer, and this axial force can be increased or decreased as desired.

When the locking device is not in use an increase or decrease in the axial force to which the stabilizer is subjected tends to cause the shaft assembly 1 to slide within the assembly 2 reducing or increasing telescopically the overall length of the stabilizer, and this movement causes the cam follower 34 to move along the cam surfaces of the projections 5, resulting in lateral extension or retraction of the fins 32. In this way an alteration in the applied axial force to the stabilizer produces an alteration in the effective diameter of the stabilizer body across the surfaces of the fins. As the fins 32 extend further outwards they engage more readily the side walls of the borehole in which the drill string is located, lessening the degree of curvature of the string. Retraction of the fins 32 reduces the overall diameter of the stabilizer and allows greater curvature of the string in the borehole. The direction of deviation of the drill bit can thus be controlled by applying a greater or lesser force to the string at the surface, the effect of this force being to control the diameter of the stabilizer.

Thus if the drill bit is found to be acting below the desired line of drilling the axial force applied to the string from the surface is increased, causing the shaft assembly 1 to move to the right relative to the assembly 2, with the result that the cam follower 34 engages a portion of the cam surfaces of lesser height, thus causing the fins 32 to retract. The curvature of the drill string therefore increases, forcing the drill bit upwards, as the stabilizer's effective diameter decreases.

Similarly the curvature of the string can be reduced, with consequent dropping of the drill bit, by reducing the axial force on the stabilizer with resulting increase in the projection of the fins 32 from the wall of the stabilizer.

Stepwise transfer of alterations in the applied force to the stabilizer diameter is achieved by means of the roller arrangement between the housing 17 and shaft 6. As the applied force increases but is insufficient to overcome the force exerted by the torsion spring 22, axial movement of the shaft assembly 1 relative to the assembly 2 is prevented by the rollers 24 engaging in the cut-outs 12. Increase of the applied force to a level sufficient to overcome the effect of the torsion spring 22 causes the rollers 24 to leave the cut-outs 12 and the shaft assembly 1 to move within the assembly 2 until the rollers 24 engage in the next adjacent cut-outs 12, again locking the shaft assemblies against further movement. Incremental movement of the shaft assemblies 1,2 is thus provided in response to predetermined levels of increase or decrease in the axial force applied to the stabilizer as a result, the fins 32 extend and retract in stepwise fashion also.

In certain circumstances it may be difficult or inconvenient to maintain an applied axial force to the stabilizer to control the positioning of the fins. In this case the locking device is utilised.

Before lowering the drill string into a bore an initial stabilizer diameter is chosen so that the bore will follow a desired path. The position of the collar 59 on the setting tool shaft 58 is then set such that length D corresponds to the longitudinal movement of the shaft assembly 1 relative to shaft assembly 2 which is required to achieve the chosen value of stabilizer diameter. The setting tool 57 is then inserted in the stabilizer such that the collar 59 passes the hydraulic valve actuator 55 and the shock absorber 60 comes to rest on the landing plate 61. After running the drill string into position in the bore an axial force is applied to the drill string such that the shaft assembly 1, and therefore the shaft 6, moves longitudinally within the shaft assembly 2. This continues until the required value of stabilizer diameter is achieved, at which point the collar 59 engages the hydraulic valve actuator 55 compressing the spring 56 and closing the valve 53. Closing the valve 53 isolates the hydraulic line 51 from the hydraulic line 52, and thus prevents the piston 44 from moving in the chamber 63. The shafts 1 and 6 are, therefore, locked in position relative to shaft assembly 2, such that the diameter of the stabilizer will remain constant regardless of any subsequent changes in the axial force applied to the drill string.

After drilling for a discrete interval with this stabilizer diameter a single shot survey instrument, with an overshot matched to the setting tool spearhead 62, is lowered through the drill string and latched onto the setting tool 57.

After a photograph of the compass unit has been taken the survey instrument and the setting tool 57 are pulled to the surface.

The survey film is then developed and studied and the next stabilizer diameter calculated. The distance D, between the collar 59 and the end of the shock absorber 60, is adjusted accordingly and the setting tool 57 placed in the drill pipe and pumped down to the stabilizer. An axial force is then applied to the drill string until the stabilizer diameter setting required is achieved and the locking device again locks shaft assembly 1 relative to shaft assembly 2.

Figure 5:
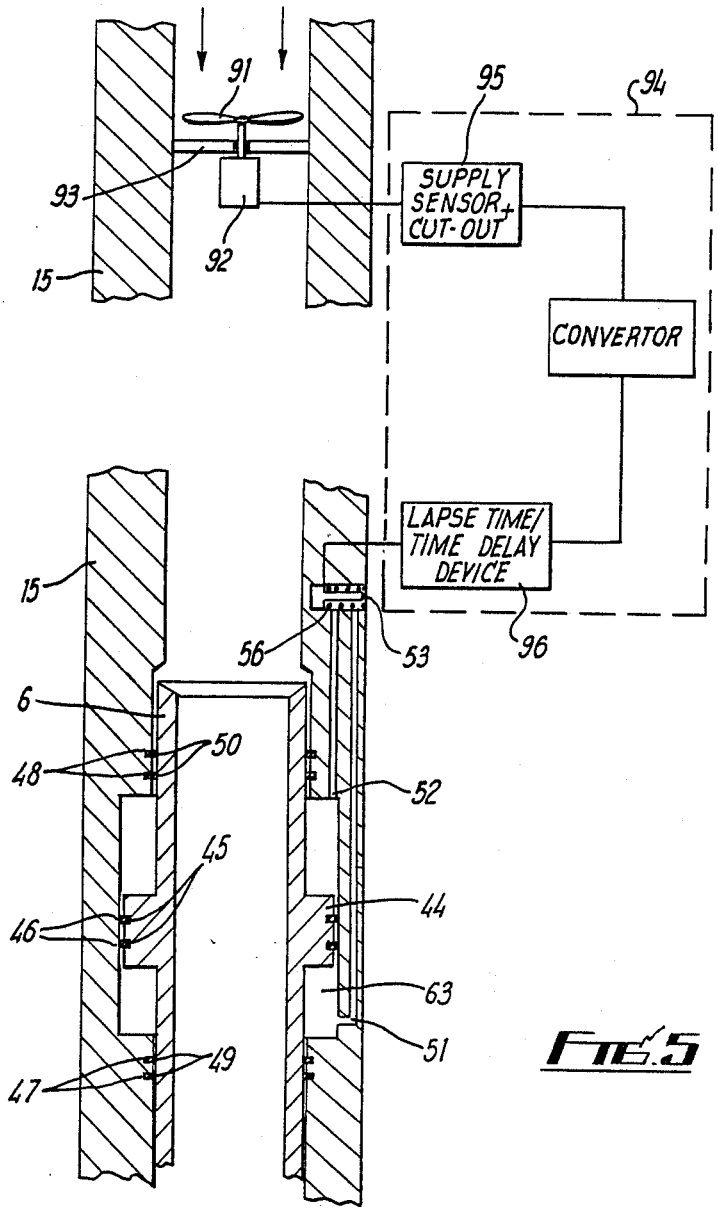
FIG. 5 is a broken sectional side view of a further embodiment of a locking device of the present invention.

In an alternative embodiment the mechanical valve actuator 55 is replaced by an electrical actuator which is controlled by a mud flow sensor as is shown in FIG. 5 of the drawings. In this case the actuator comprises an impeller 91 provided in the bore of the shaft 15 and linked to a generator 92 which is, in turn, connected to a control circuit 94. The impeller 91 and generator 92 are secured in the shaft 15 by means of a removable centralized mounting 93.

When the mud flow rate is at the normal operating level the impeller 91 is rotated by the mud passing through the stabilizer and drives the generator 92 which provides a supply of electricity for the control circuit 94. A supply sensor 95 in the control circuit 94 senses the amount of electricity being generated, this being directly proportional to the impeller speed and, therefore, directly proportional to the mud flow rate.

When the mud flow rate is raised above the normal operating rate level the impeller 91 is rotated at a faster rate and thus additional electricity is generated. The supply sensor 95 supplies this additional electricity to the valve 53 which is provided with an electric drive motor. The motor acts against the spring 56 and opens the valve 53 so that the piston 44 may be moved within the chamber 63.

If the mud flow rate is then returned to normal operating level the supply sensor 95 senses the change in electricity being generated and the circuit 94 is energised and configured to activate a lapse time/time delay device 96 which operates the motor to close the valve 53 after an appropriate time interval.

In further embodiments the control circuit 94 may be provided with an accumulator in place of a generator and a flow rate meter in place of an impeller.

Figure 6:
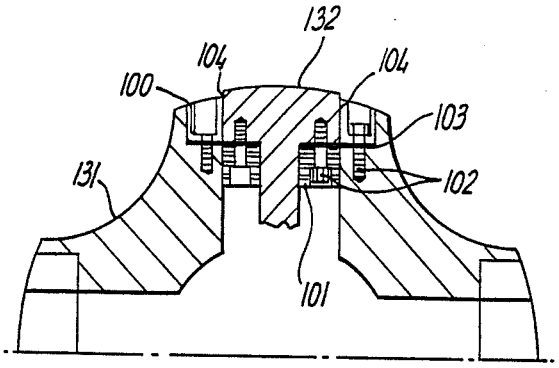
FIG. 6 is a sectional plan view of an alternative sealing arrangement for a fin of a stabilizer.
Figure 7:
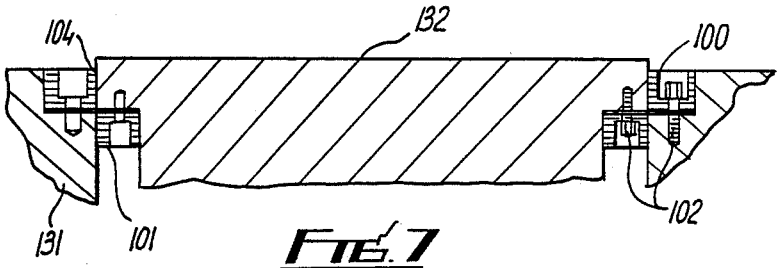
FIG. 7 is a sectional side view of the fin of FIG. 6.
Figure 8:
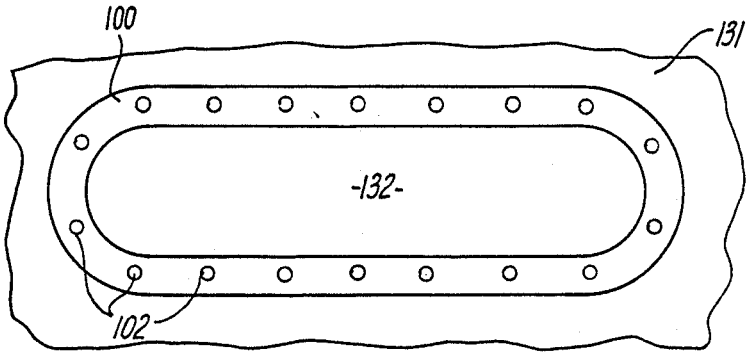
FIG. 8 is a end view of the fin of FIG. 6.

FIGS. 6 to 8 show an alternative sealing arrangement for the fin of a stabilizer or the type described above.

Problems arise in the use of O-ring and gland type seals between the movable fin and its aperture in the housing. The migration of abrasive particles due to the sliding action of the fin, the shape of the area being sealed and the loads experienced by the fin all tend to cause conventional seals to deteriorate rapidly.

To overcome this problem a diaphragm 103 is mounted between and orthogonal to the sliding surfaces 104 between a fin 132 and its housing 131. The diaphragm 103, which is of complementary shape to the sliding surfaces 104, is clamped between the fin 132 and an inner clamp ring 101 which is secured by a number of high tensile bolts 102. This subassembly is then mounted in a complementary aperture in the housing 131 and an outer clamp ring 100 placed around the fin 132 and secured over the outer edge of the diaphragm 103 using a number of high tensile bolts 102. Thus, the transfer of fluid or the ingression of foreign particles between the sliding surfaces 104 is prevented.

FIG. 7 shows an alternative cam profile and fin for use in a stabilizer.

Figure 9:
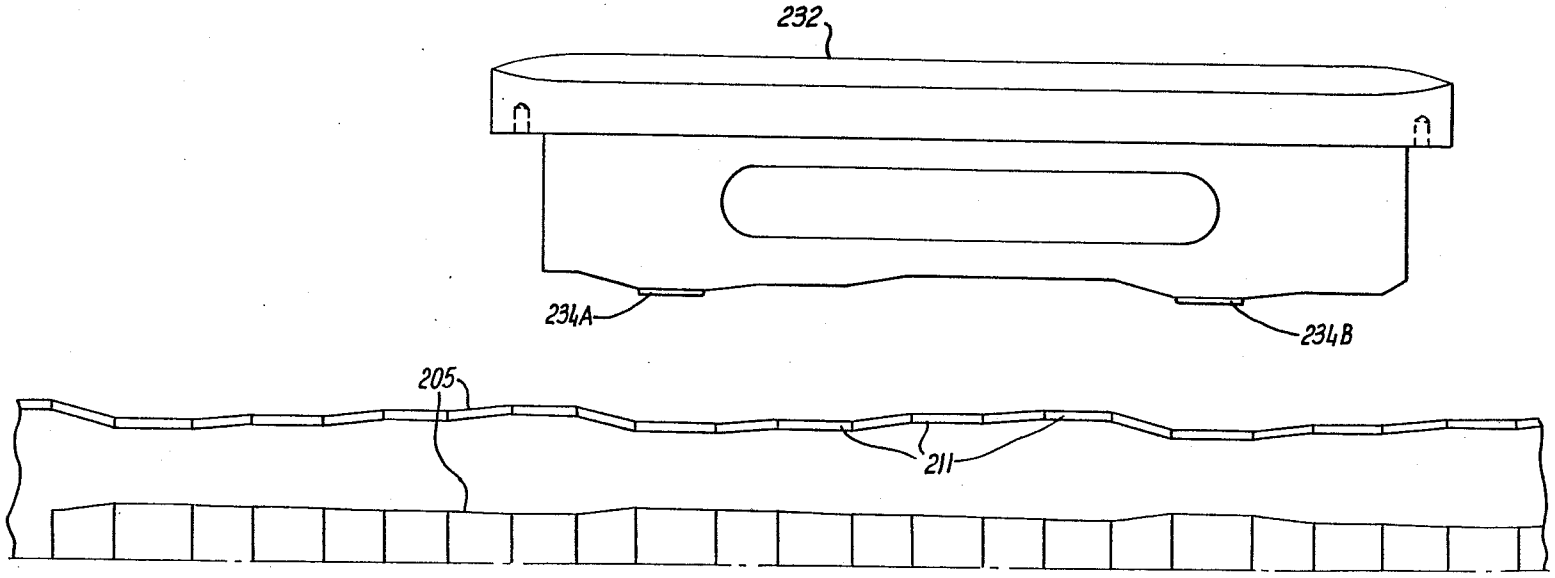
FIG. 9 is an exploded side view of an alternative cam profile and fin of a stabilizer.

In the stabilizer described above each fin 32 is provided with a singular cam follower 34 which bears against a linear tapered projection 5 along the length of the drive shaft 3. In the fin 232 and cam 205 shown in FIG. 9 the fin 232 is provided with two cam followers 234A and 234B at its end portions to help prevent unequal movement at the extreme outer edges of the fin 232 in the direction orthogonal to the axis of the stabiliser.

The fin 232 is supported at the two non-contiguous followers 234A and 232B in all positions and these follow a non-linear assymetrical longitudinal profile 211 which effects the stepwise radial movement of the fin 232.

Figure 10:
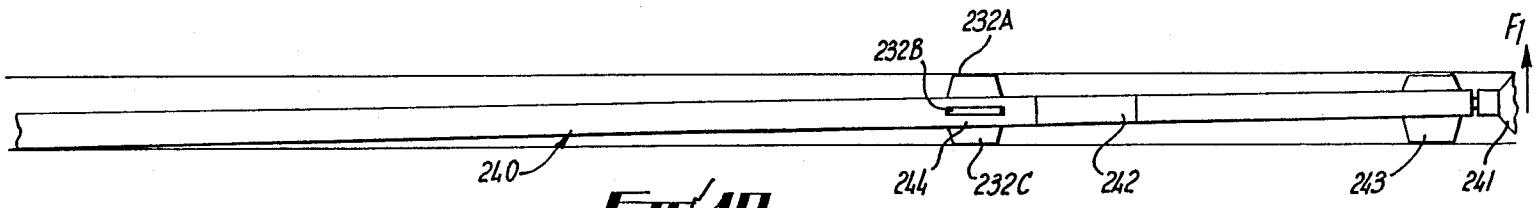
FIGS. 10 and 11 are diagrammatic views of the end of a drill string having mud motor drive, an offset near-bit stabilizer and a drill string stabilizer.
Figure 11:
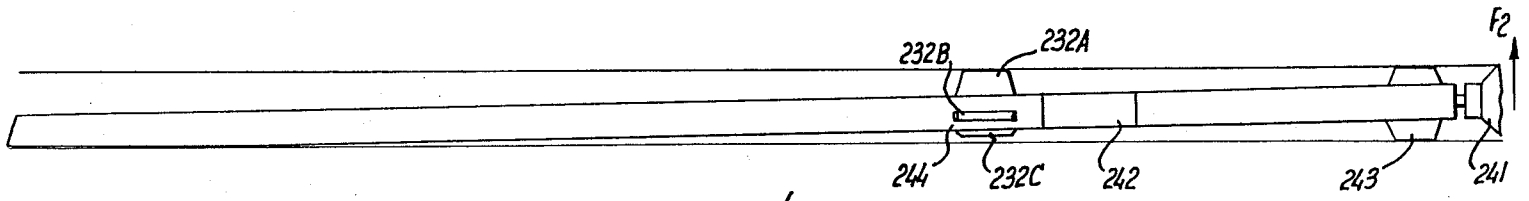
Figure 12:
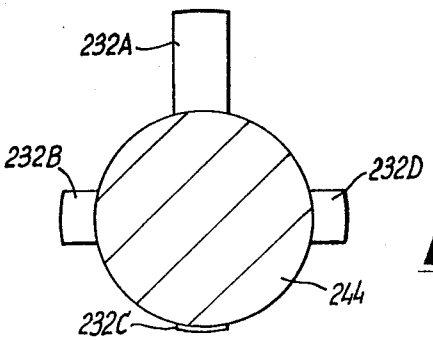
FIG. 12 is a diagrammatic end view of the drill string stabilizer of FIG. 11.

Now referring also to FIGS. 10 to 12 of the drawings the cams 205 which support each of the four fins 232A–D may be arranged such that in certain stabilizer settings the fins 232A–D are differentially extended. This feature is particularly useful when a down hole mud motor is used to drive a drill bit on a drill string.

FIGS. 10 and 11 show a drill string 240 having a bit 241 which is driven by a mud motor 242. The direction of drilling is controlled by means of a fixed offset stabilizer 243 fitted adjacent the bit 241 and an adjustable stabilizer 244 fitted above the mud motor 242.

In FIG. 10 the adjustable stabilizer 244 is set, as a conventional stabilizer, with each of the fins 232A–D extending equally from the body of the stabilizer. The change of direction of drilling is related to the bit sideforce, represented by arrow $F_1$ and this is limited by the offset in the drill string caused by the combined effects of the two stabilizers 243 and 244. Previously a greater offset was achieved by placing a bent length of pipe in the drill string 240 and aligning the drill string 240 from the surface such that the bend in the pipe offset the bit 241 to the desired direction of drilling.

FIG. 11 shows how, by differentially extending the fins 232A–D of the stabilizer 244 it is possible to displace the drill string in the bore. A greater offset, and thus a greater bit sideforce represented by arrow $F_2$ can be achieved with the stabilizer set in this manner without having to remove the drill string to fit bent pipes as was necessary previously.

This form of stabilizer may also be used to useful effect on top driven drill strings.

Figure 13:
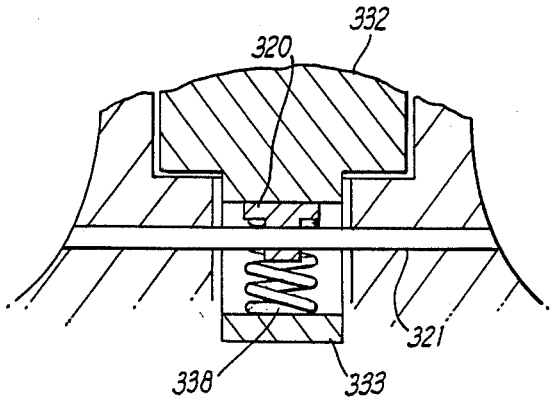
FIG. 13 is a sectional plan view of an alternative mounting arrangement for a fin of a stabilizer.
Figure 14:
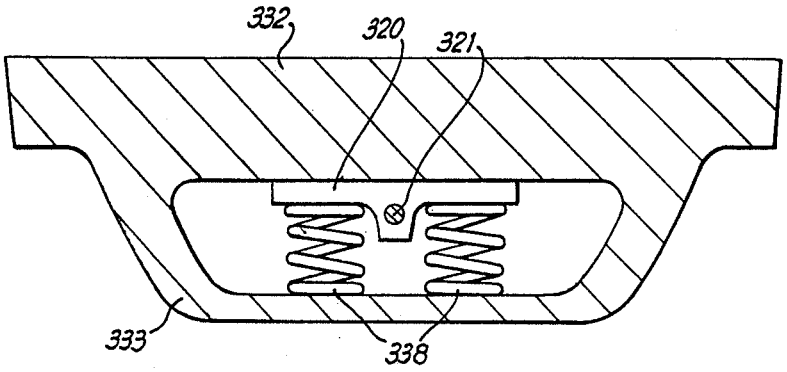
FIG. 14 is a side view of the fin of FIG. 13.

FIGS. 13 and 14 show an alternative mounting arrangement for a fin 232 of a stabilizer as described above. Instead of having a spring 38 housed in a recess 36 from the outside, as described above, helical coiled springs 338 of this arrangement are mounted internally within the frame 333 of the fin 332 and are thus offered protection by the body of the fin 332.

A rocker 320 is seated above the preloaded springs 338 and a pin 321 is passed through the housing 331 within which the fin is located, to secure the rocker 320 and to prevent the uppermost part of the spring subassembly from moving radially outwards.

In an alternative arrangement the helical coiled spring may be replaced by a leaf spring.

Modifications and improvements may be made without departing from the scope of the invention.

I claim:

1. A locking device for use in an adjustable stabilizer, comprising: a first body member having a fluid reservoir, said fluid reservoir being divided into two chambers by a moveable sealing member secured on a second body member moveable relative to said first body member, said two chambers of said reservoir being in fluid communication through a valve means for closing said fluid communication between said chambers and locking said adjustable stabilizer in a selected position, said valve means including means for prohibiting fluid transfer between said chambers to prevent any motion by said moveable sealing member within said fluid reservoir relative to said first body member, said valve means, said sealing member, said first body member and said second body member cooperating to prevent any motion by said second body member relative to said first body member when said valve means is closed.

2. The locking device according to claim 1, wherein said first and second body members define said fluid reservoir.

3. The locking device according to claim 1, wherein said fluid reservoir is in the form of an annular chamber.

4. The locking device according to claim 1, wherein said sealing member is in the form of a piston mounted on said second body member and extending into said fluid reservoir.

5. The locking device according to claim 1, wherein said second body member is slidably moveable within said first body member.

6. The locking device according to claim 5, further comprising a setting tool wherein said valve means is mounted in said first body member; a setting tool comprising an elongate member having a cam surface for engaging said valve means, said setting tool being supported by a portion of said second body member for causing said cam surface to engage and close said valve means upon movement of said second body member relative to said first body member.

7. The locking device according to claim 6, wherein said cam surface is adjustably positioned along said elongate member of said setting tool.

8. The locking device according to claim 1, further comprising electrical drive means for actuating said valve means and a sensor for detecting changes in fluid flow through the stabilizer, said sensor having means for activating said electrical drive means to actuate said valve means on detection of such changes in fluid flow.

9. The locking device according to claim 8, wherein time delay means is incorporated between said sensor and said electrical drive means for activating said electrical drive means when a predetermined time interval has elapsed following said sensor detecting a change in fluid flow.

10. An adjustable stabilizer comprising: a first outer body member having radially moveable projection members mounted thereon, and a second inner body member slidably moveable within said outer body member, portions of said projection members bearing on cam portions provided on said inner body member to effect radial movement of said projection members upon axial movement of said inner body member relative to said outer body member, said stabilizer being provided with a locking device comprising a fluid reservoir provided in said outer body member, said fluid reservoir being divided into two chambers by a moveable sealing member secured on said inner body member, said two chambers of said reservoir being in fluid communication through a valve means for closing said fluid communication between said chambers and locking said adjustable stabilizer in a selected position, said valve means including means for prohibiting fluid transfer between said chambers to prevent any motion by said moveable sealing member within said fluid reservoir relative to said first body member, said valve means, said sealing member, said first body member and said second body member cooperating to prevent any motion by said second body member relative to said first body member when said valve means is closed.

11. An adjustable stabilizer comprising a first outer body member having radially moveable projection members mounted thereon, and a second inner body member slidably moveable within said outer body member, cam portions provided on said inner body member, portions of said projection members bearing on said cam portions provided on said inner body member to effect radial movement by said projection members upon axial movement of said inner body member relative to said outer body member, part of the profile of at least one of said cam portions differing from the corresponding profiles of said other cam portions such that in a selected relative position of said inner body and outer body members said projection member of said one cam portion is radially displaced from said outer body member to an extent different from said projection members of said other cam portions.

12. The adjustable stabilizer according to claim 11, wherein said cam portions have non-liner profiles.

13. The adjustable stabilizer according to claim 11, wherein each said projection member is provided with two follower portions, one at each end portion of said projection member.

* * * * *